United States Patent [19]

Marchant et al.

[11] 4,193,544

[45] Mar. 18, 1980

[54] RAIL CLIP ASSEMBLIES

[75] Inventors: Ian M. Marchant, Ashtead; Warwick S. Faville, London, both of England

[73] Assignee: Kins Developments Limited, Epsom, England

[21] Appl. No.: 878,591

[22] Filed: Feb. 16, 1978

Related U.S. Application Data

[63] Continuation of Ser. No. 700,811, Jun. 29, 1976, abandoned.

[30] Foreign Application Priority Data

Jun. 30, 1975 [GB] United Kingdom ..... 27516/75

[51] Int. Cl.[2] ..... E01B 9/00

[52] U.S. Cl. ..... 238/347; 238/331; 238/338; 238/349; 238/362

[58] Field of Search ..... 238/201, 203, 282, 310, 238/315, 333, 334, 338, 347, 349, 361, 362, 363, 364, 331

[56] References Cited

U.S. PATENT DOCUMENTS

| | | | |
|---|---|---|---|
| 866,743 | 9/1907 | Stoner | 238/362 X |
| 1,126,533 | 1/1915 | Liebmann | 238/347 X |
| 1,126,534 | 1/1915 | Liebmann | 238/347 |
| 1,279,723 | 9/1918 | Liebmann | 238/347 X |
| 3,784,097 | 1/1974 | Landis | 238/282 X |
| 3,831,842 | 8/1974 | Tamura | 238/282 X |
| 3,923,245 | 12/1975 | Marchant | 238/347 |

FOREIGN PATENT DOCUMENTS

| | | | |
|---|---|---|---|
| 1158060 | 7/1969 | United Kingdom | 238/349 |

*Primary Examiner*—Randolph A. Reese

*Attorney, Agent, or Firm*—Scrivener, Parker, Scrivener and Clarke

[57] ABSTRACT

A rail clip assembly for securing for example a crane rail to a girder, comprises a first part to be securely attached, e.g. by welding or bolting, to the planar surface of the girder adjacent the rail, and a second part to be fixed to the first part independently of attachment of the first part to the girder. The second part has a lateral surface for abutment with a lateral face of the rail and the parts have laterally directed cooperating surfaces by which forces applied by the rail to the clip assembly are transmitted via the second part to the first part of the clip assembly. The cooperating surfaces are inclined to the direction of extent of the rail and the second part has an elongate aperture for receiving the fixing means which is elongate in the same direction to permit relative adjustment movement between the parts while maintaining the cooperating surfaces in contact. At least the first part is wedge shaped and increasing in thickness in the direction of approach of the cooperating surfaces to the rail so that lateral forces applied by the rail to the clip assembly produce and are resisted by an increase in the tension in the fixing means.

11 Claims, 11 Drawing Figures

RAIL CLIP ASSEMBLIES

This is a continuation of application Ser. No. 700,811, filed June 29, 1976, now abandoned.

The present invention relates to the improvements in rail clip assemblies for exclusively securing a rail, such as a crane rail, to a continuous support having a planar surface such as a flanged girder.

According to the present invention there is provided a rail clip assembly for securing a rail to a continuous planar support surface, the assembly comprising a first part adapted to bear on and be securely attached to the support surface adjacent the rail and having an under surface for contacting the support surface, a second part adapted to overlie the first part and having a lateral surface for abutment with a lateral face of the rail, and fixing means for fixing the second part relative to the first part independently of attachment of the first part to the rail support, wherein the second part has an elongate aperture therethrough through which the fixing means will extend and to enable the second part to assume different positions relative to the first part, the aperture extending in a direction inclined to the longitudinal direction of the rail, the first and second parts having cooperating laterally directed surfaces which are abutted in all relative positions of the parts for transmitting to the first part laterally directed forces applied to the second part by the rail, the surfaces extending parallel to the direction of extent of the aperture, at least the first part being wedge shaped and decreasing in thickness in the direction of approach of the aperture to the rail.

The present invention will be more fully understood from the following description of embodiments thereof, given by way of example only, with reference to the accompanying drawings, in which.

Figure 1:
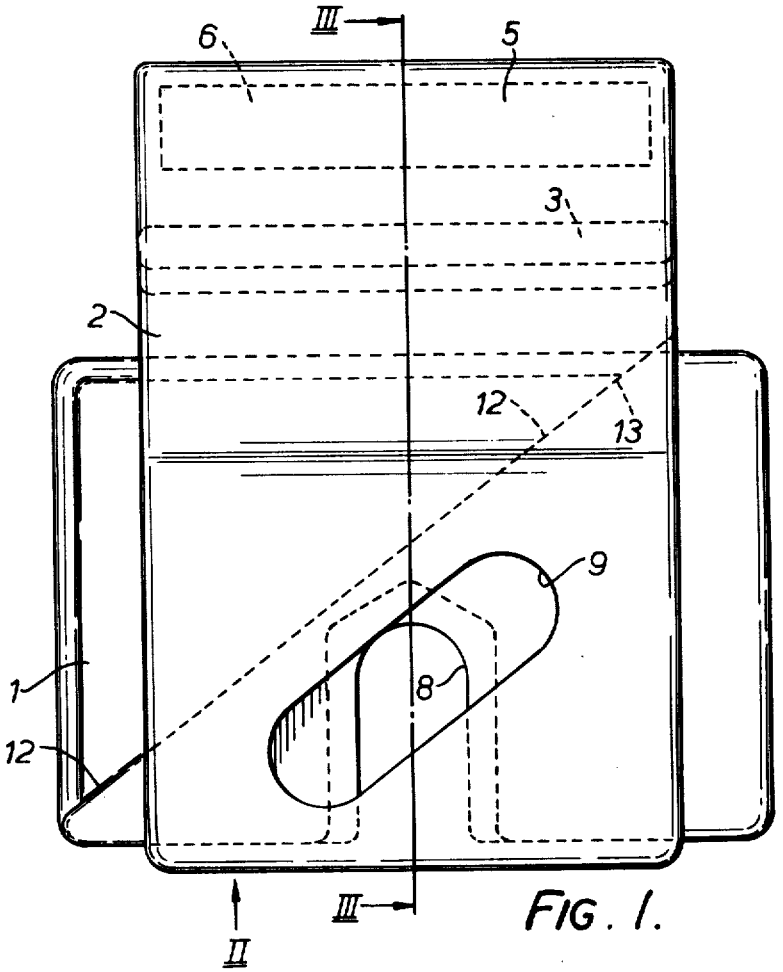
FIG. 1 is a plan view of an embodiment of a rail clip assembly according to the present invention.
Figure 2:
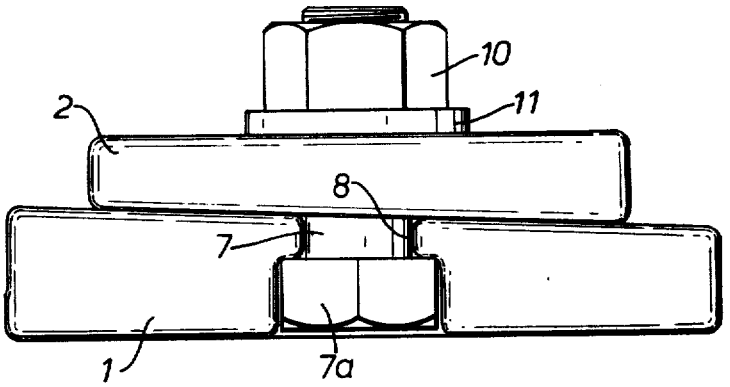
FIG. 2 is an elevation in the direction of arrow II in FIG. 1 of the rail clip assembly of FIG. 1.
Figure 3:
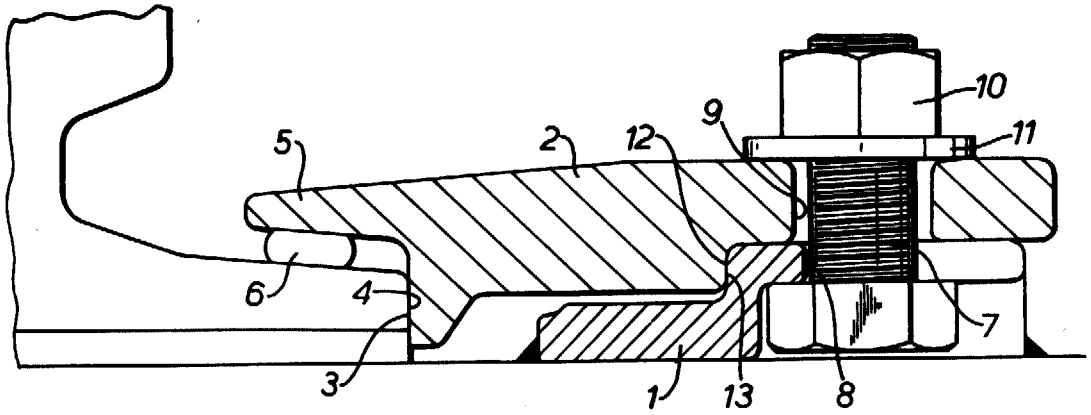
FIG. 3 is a section on the line III—III of FIG. 1.

The rail assembly shown in FIGS. 1 to 3 comprises a generally rectangular first part 1 which has a planar lower surface for bearing on the rail support, the part 1 being adapted to be welded to the rail support in an approximate position relative to the rail by one or more welds extending around its periphery. A generally rectangular second part 2 overlies the first part 1 and has a lateral surface 3 for abutment with the lateral face 4 of the rail flange. In this embodiment the part 2 is formed with an extension 5 which overlies the rail flange and may carry a resilient member 6 which bears on the rail, if it is desired that the clip assembly should positively locate the rail against upward movement. If the clip assembly is merely required to prevent undue upward movement, the member 6 is omitted.

The parts 1, 2 are fixed together by a bolt 7 whose head 7*a* is located in a recess in the under side of the part 1 and which projects through apertures 8, 9 in the parts 1, 2 respectively. A nut 10 with a washer 11 is engaged on the upper threaded end of the bolt. The aperture 8 in part 1 is extended through a slot 8*c* to the edge of this part to enable the bolt to be placed in position after part 1 has been welded to the rail support. The aperture 9 in part 2 is elongate in a direction inclined to the direction of extent of the rail to enable part 2 to be moved relative to part 1 to abut surface 3 with surface 4 and to thereby accommodate variations in the positioning of part 1 relative to the rail and to permit repositioning of the rail.

The contacting surfaces of the parts 1 and 2 include opposed laterally directed surfaces 12, 13 which extend parallel to the direction of extent of the aperture 9, are arranged to be abutted in all relative positions of the parts, and are arranged so that laterally directed forces exerted by the rail on the part 2 are communicated via the abutted faces 12, 13 to part 1 and thereby to the rail support. It will be appreciated that the fixing means, e.g. the belt 7 and nut 10, play no part in directly resisting lateral forces on the clip assembly.

While one pair of abutted surfaces is provided in the embodiment illustrated in FIGS. 1 to 3, it will be appreciated that two or more such pairs of surfaces may be provided.

The body 2 is a wedge shaped, decreasing in thickness in the direction of elongation of the aperture 9 away from the rail, so that, should relative movement occur between the parts 1 and 2, caused by lateral movement of the rail, this movement will cause an increase in the tension in the bolt 7 and therefore increase frictional forces between the two parts 1 and 2, to resist further lateral movement. The part 1 is preferably oppositely wedge shaped to maintain the upper and lower surfaces of the parts parallel inter alia to avoid bending the bolt.

The above described clip assembly is intended to be capable of resisting laterally directed forces of up to about 30 tons. The parts 1 and 2 may be made of forged or cast steel and the member 6, if provided, may be made of rubber or an elastomeric material.

Figure 4:
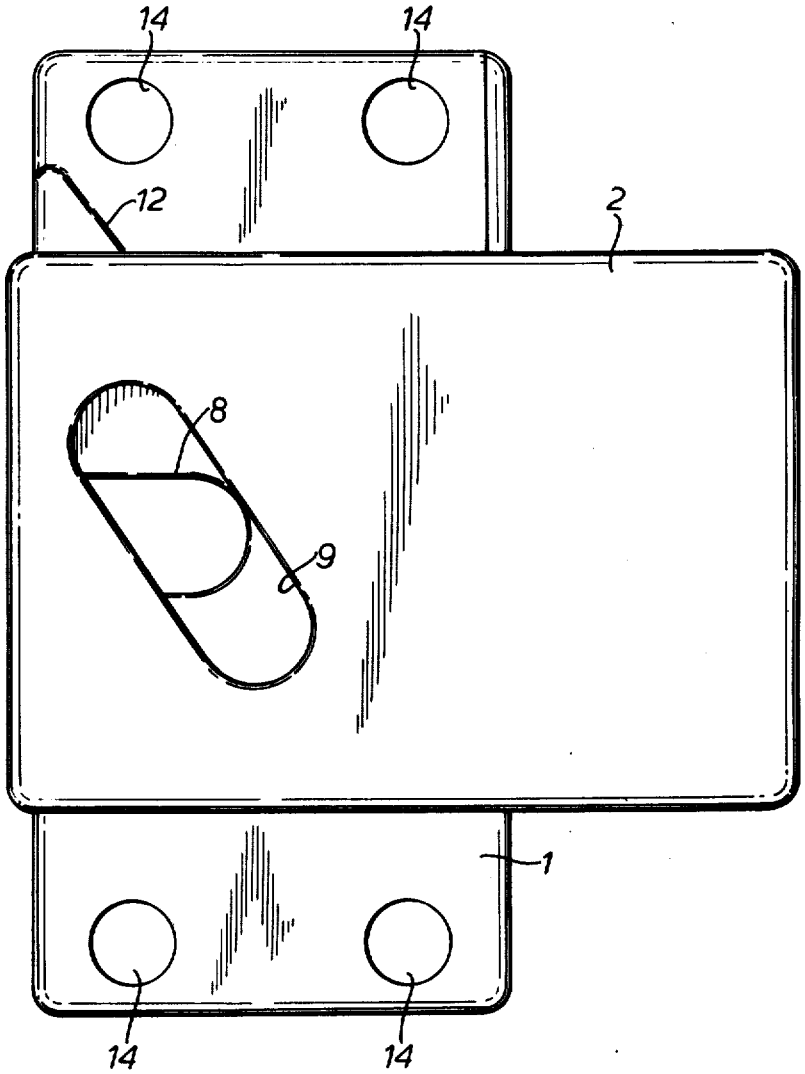
FIG. 4 is a plan view of a modification of the embodiment of FIG. 1.

In a modification of the above described clip assembly shown in FIG. 4, the part 1 is designed to be secured to the rail support by friction grip bolts. To this end the part 1 is made longer and provided with four apertures 14 in its four corners for receiving the bolts. This clip assembly is otherwise the same as that shown in FIGS. 1 to 3.

Figure 7:
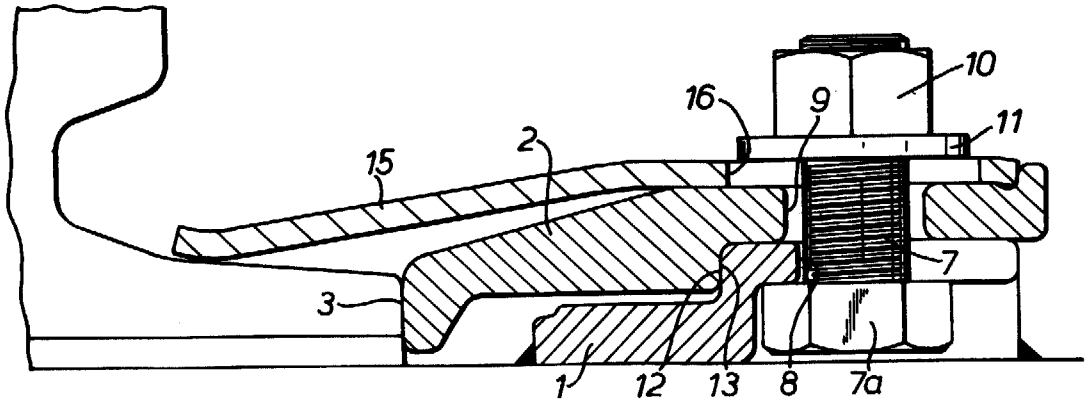
FIG. 7 is a section on the line VII—VII of FIG. 5.
Figure 5:
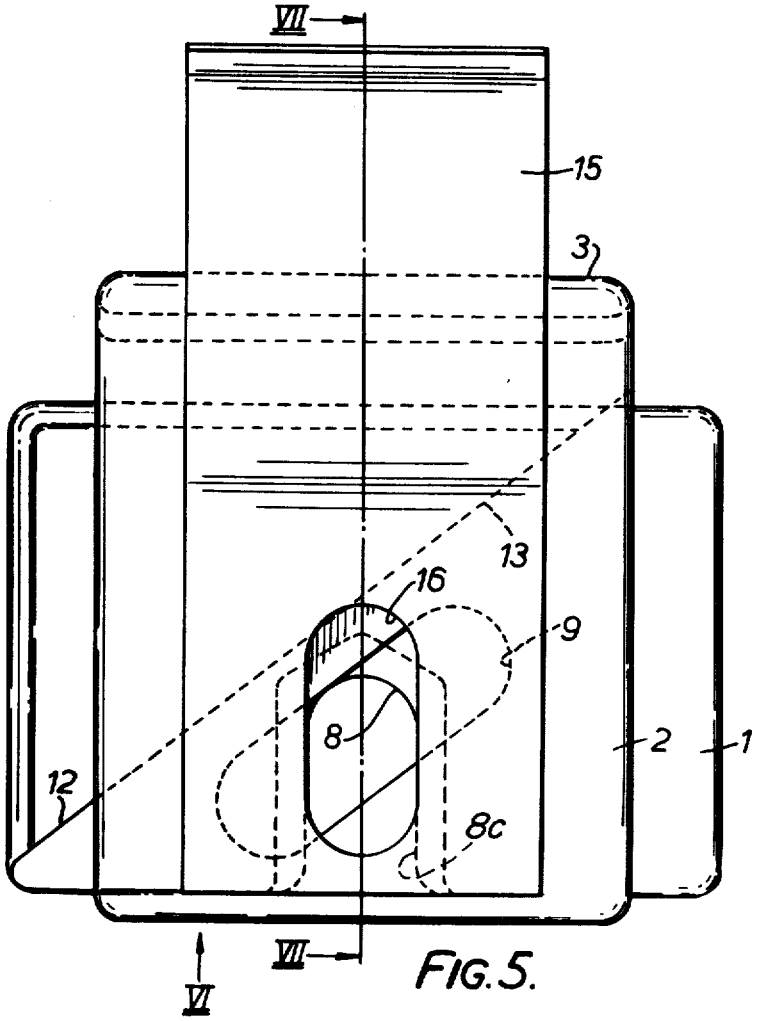
FIG. 5 is a plan view of another embodiment of a rail clip assembly according to the invention.
Figure 6:
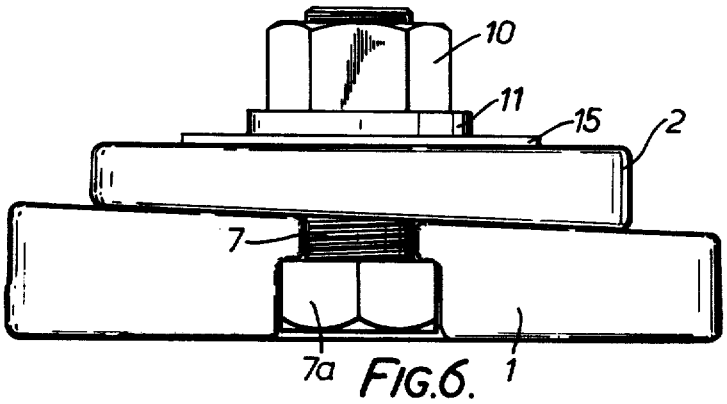
FIG. 6 is an elevation in the direction of the arrow VI in FIG. 5.
Figure 8:
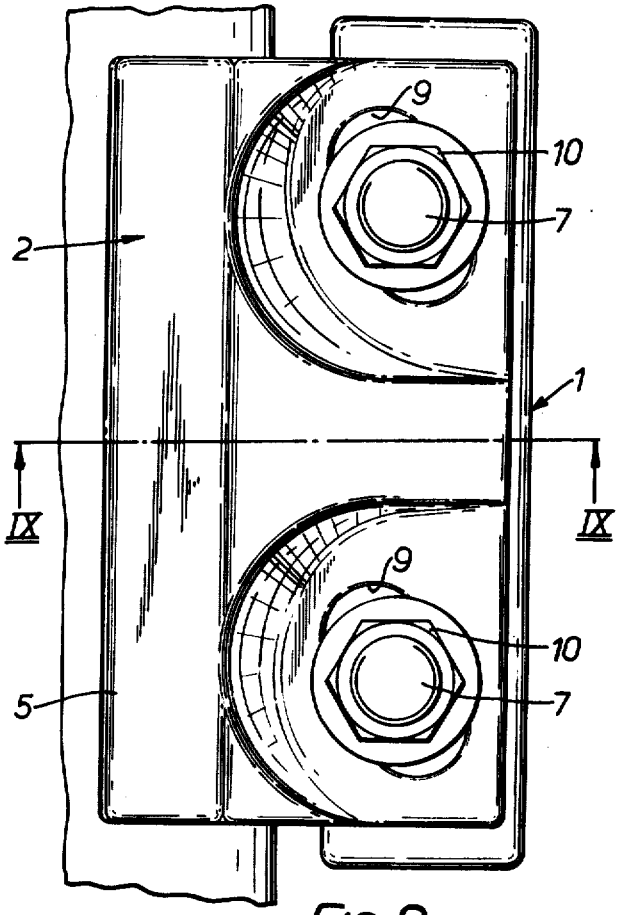
FIG. 8 is a plan view of a further embodiment of a rail clip assembly according to the invention.
Figure 9:
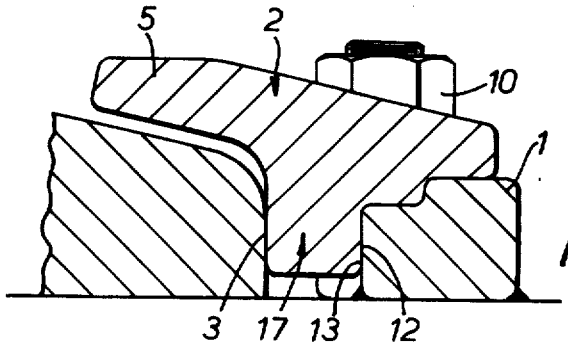
FIG. 9 is a section on the line IX—IX of FIG. 8.
Figure 10:
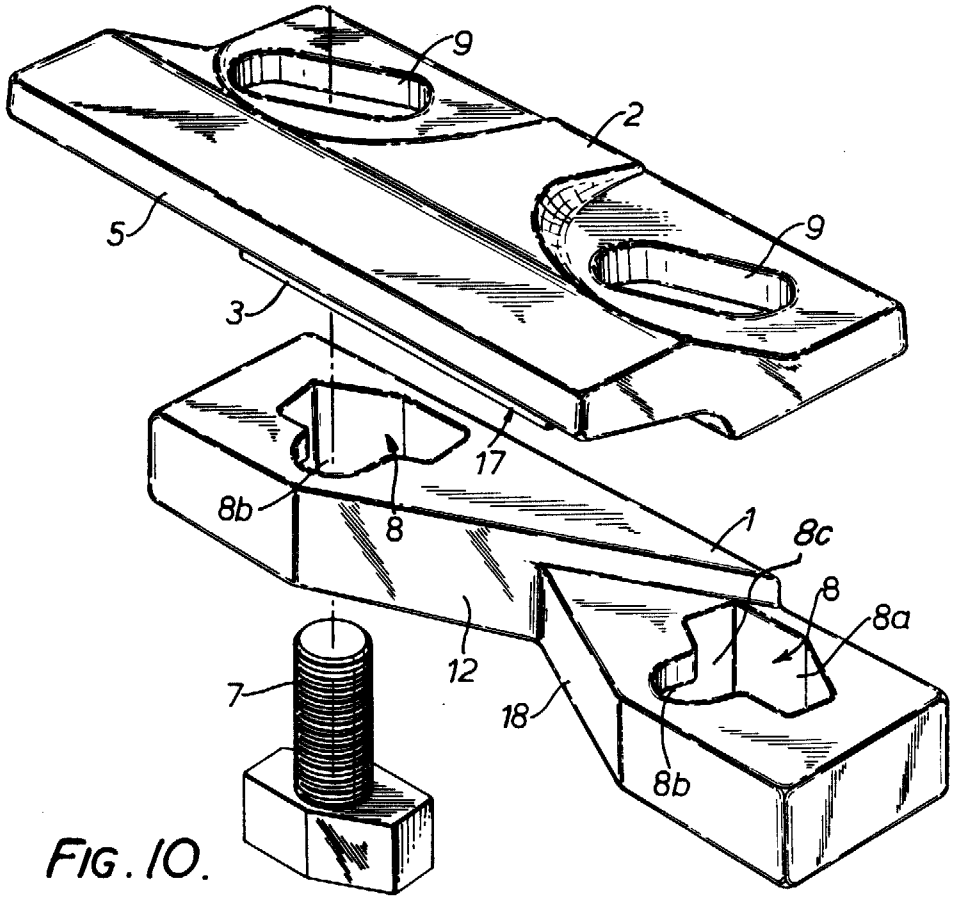
FIG. 10 is an exploded perspective view of the assembly of FIG. 8.

In another embodiment of a clip assembly, shown in FIGS. 5 to 7, the clip assembly is similar to that shown in FIGS. 1 to 3 and the same reference numerals have been used for like parts. However, in this embodiment the extension 5 of part 2 of the embodiment of FIGS. 1 to 3 has been omitted and the function of holding down the rail is performed by a third part 15 which may be made of spring steel. Part 15 is held relative to the parts 1 and 2 by the bolt 10. To allow the part 15 to have a variable position relative to the first part 1, part 15 is provided with an aperture 16 for receiving the bolt 7 which is elongate in a direction receiving the bolt 7 which is elongate in a direction perpendicular to the rail extent. It will be appreciated that this embodiment can also be modified as shown in FIG. 4.

Each of the above described embodiments may be modified to include two or more fixing bolts, the first part 1 being provided with two or more apertures 8 and the second part 2 being provided with corresponding parallel elongate apertures 9.

Figure 11:
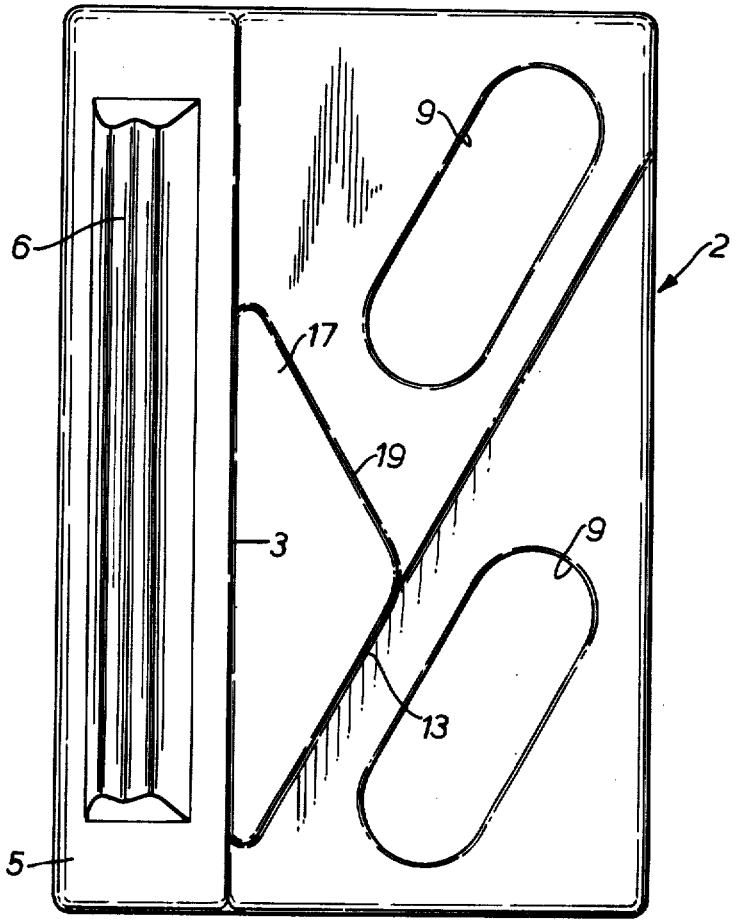
FIG. 11 is a plan view from underneath of a part of the assembly of FIG. 8.

FIGS. 8 to 11 illustrate a further embodiment of clip assembly which includes two fixing bolts 7. This embodiment is similar to that shown in FIGS. 1 and 2, the same reference numerals having been used for like parts. As in the first embodiment, part 1 is intended to be welded round its periphery to the rail support. It could, however, be modified as shown in FIG. 4 for bolting to the rail support. The second part 2 has a lateral surface 3 for abutment with a lateral face of the rail and an extension 5 overlying the rail flange. The extension 5 may, as shown in FIG. 11, be provided with a resilient member 6. The two parts 1, 2 have two pairs of apertures 8 and 9, apertures 9 being elongate in parallel directions, for receiving bolts 7 with nuts 10. In this embodiment the parts 1, 2 are intended to be fixed together by bolts 7 for example, as shown, hammer head bolts, which are introduced into the apertures 8 from above, and engaged with the first part 1. The apertures 8 accordingly have a part 8*a*, shaped to allow the bolt head to pass through and a part 8*b* of reduced section, joined to the part 8*a* by a slot 8*c*, for engaging the bolt shank and with a recess in the under surface for receiving the bolt head.

In this embodiment the opposed abutted laterally directed faces 12, 13 are provided mainly by a lateral face of the first part 1 and on a downwardly extending projection 17 on the second part 2, the lateral face 3 also being provided on this projection 17. As shown the projection has a generally triangular horizontal section and the lateral face of the first part has a corresponding V profile. Face 18 of the V profile and face 19 of the projection come into abutment in one limiting position of the assembly.

As in the preceding embodiments, the parts 1, 2 of the assembly of FIGS. 8 to 11 are complementarily wedge shaped so as to increase the tension in the bolts 7 on movement of the rail against the assembly.

We claim:

1. A rail clip assembly for securing a rail to a support, said assembly comprising: a first part to be fixed relative to the rail support adjacent the rail and having a first face adapted to face the rail and extend generally parallel thereto, and a second face extending from said first face away from said rail in a direction inclined at an acute angle to the longitudinal direction of the rail; a second part adapted to overlie said first part and having first and second relatively inclined faces, said first and second faces being on a portion of said second part which in use extends between said second face of said first part and said rail with the first face of said portion being in abutment with a longitudinally extending face of the rail and with the second face of said portion being in abutment with said second face of said first part in all relative positions of said parts for transmitting to said first part laterally directed forces applied to said second part by the rail, fixing means for fixing said second part to said first part independently of fixing of said first part to said rail support, said fixing means including a member having an enlarged head for engagement in said first part and a shank, said parts each having an aperture therein which align with each other and through which said shank of said fixing member extends when said second faces are in abutment, said aperture in said second part being elongated in a direction parallel with the direction of extent of the second face of said second part to enable said parts to assume different relative positions when said shank extends through said aperture and while said abutted faces remain in abutment, said aperture in said first part extending at its lower end into a recess dimensioned to receive said enlarged head of said fixing member and communicating through a slot, constituting an extension of said aperture, with an opening whereby said head of said fixing member can be engaged with said first part with said shank extending through said aperture therein after said first part has been fixed to the rail support, said aperture and slot in said first part extending in a direction inclined to said direction of the second face of said first part such that when said first and second parts are assembled with the second faces thereof in abutment, said fixing member extends through said aligned apertures therein but is prevented by said second part from moving through said slot in said first part.

2. A rail clip assembly as claimed in claim 1, wherein said first part is adapted to be welded to the rail support.

3. A rail clip assembly as claimed in claim 1, wherein said first part is adapted to be permanently bolted to the rail support.

4. A rail clip assembly as claimed in claim 1, wherein said second part overlies the rail for limiting movement of the rail away from the rail support.

5. A rail clip assembly as claimed in claim 4, wherein said second part has a resilient member for bearing on the rail to substantially prevent movement of the rail away from the rail support.

6. A rail clip assembly as claimed in claim 1, including a third part for overlying and for abutment with the rail, said third part including at least one elongate aperture through which said fixing means extend for fixing said third part relative to said first and second parts, said aperture in said third part being elongate in a direction perpendicular to the longitudinal direction of the rail to permit movement of said third part relative to said first and second parts.

7. A rail clip assembly as claimed in claim 6, wherein said third part is made of resilient material.

8. The rail clip assembly of claim 1 wherein said slot opens through the edge of said first part remote from the face facing said rail and said opening comprises the open end of said slot.

9. The rail clip assembly of claim 1 wherein said opening extends through said first part, said opening being dimensioned so that said enlarged head of said fixing means can pass through said opening from above when said first part is fixed to the rail support.

10. The rail clip of claim 1 wherein said parts are oppositely wedge shaped in a direction parallel to the direction of extent of the rail, said first part decreasing in thickness in the direction of approach of said cooperating laterally directed surfaces to the rail.

11. A rail clip assembly for securing a rail to a support, said assembly comprising: a first part to be fixed relative to the rail support adjacent the rail and having a face facing the rail and for extending generally parallel thereto and defining a V-shaped recess therein; a second part adapted to overlie said first part and to overlie a part of the rail to at least limit movement of the rail away from the rail support, and having a downwardly extending triangular section projection defining three surfaces, said projection in use being received in said recess with one of said surfaces of said projection defining a face for abutment with a face of the rail and with another of said surfaces of said projection in abutment with one surface of said V-shaped recess in all relative positions of said parts for transmitting to said first part laterally directed forces applied to said second part by the rail, said abutted surfaces of said parts extending in a direction inclined at an acute angle to the longitudinal direction of the rail; fixing means for fixing said second part to said first part independently of fixing of said first part to said rail support, said fixing means including two members each having a shank and an enlarged head for engagement in said first part, said parts each having two apertures therein, one to each side of said recess and projection respectively, through which said shanks of said fixing members extend, said apertures in said second part being elongated in directions parallel with the direction of extent of said abutted surfaces to enable said parts when said shanks are received in said apertures to assume different relative positions while said abutted surfaces remain in abutment, each said aperture in said first part extending at its lower end into a recess dimensioned to receive said enlarged head of said fixing member and communicating through a slot, constituting an extension of said aperture, with an opening whereby said head of one of said fixing members can be engaged with said first part with said shank extending through said respective aperture therein after said first part has been fixed to the rail support, each said aperture and slot in said first part extending in a direction inclined to said direction of said abutted surfaces such that when said first and second parts are assembled with said abutted surfaces thereof in abutment said fixing members extend through said aligned apertures therein but are prevented by said second part from moving through said slots in said first part.

* * * * *